US010008355B2

(12) United States Patent
Bouazza et al.

(10) Patent No.: US 10,008,355 B2
(45) **Date of Patent: *Jun. 26, 2018**

(54) CONTROL SYSTEM FOR A BREAKER POLE WITH FORCING, AND BREAKER GEAR

(71) Applicant: SOCOMEC, Benfeld (FR)

(72) Inventors: Yassine Bouazza, Erstein (FR); Roger Dumont, Benfeld (FR); Damien Rogosinski, Selestat (FR)

(73) Assignee: SOCOMEC, Benfeld (FR)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/554,669

(22) PCT Filed: Mar. 3, 2016

(86) PCT No.: PCT/FR2016/050479

§ 371 (c)(1),
(2) Date: Aug. 30, 2017

(87) PCT Pub. No.: WO2016/142605

PCT Pub. Date: Sep. 15, 2016

(65) Prior Publication Data

US 2018/0040447 A1 Feb. 8, 2018

(30) Foreign Application Priority Data

Mar. 6, 2015 (FR) ..... 15 51909

(51) Int. Cl.
*H01H 71/50* (2006.01)
*H01H 71/52* (2006.01)

(52) U.S. Cl.
CPC ..... *H01H 71/501* (2013.01); *H01H 71/52* (2013.01); *H01H 2235/01* (2013.01)

(58) Field of Classification Search
CPC .. H01H 71/501; H01H 71/52; H01H 2235/01; H01H 21/30; H01H 21/36;
(Continued)

(56) References Cited

U.S. PATENT DOCUMENTS 4,409,449 A * 10/1983 Takano ..... H01H 3/30 200/400
5,004,875 A * 4/1991 Moody ..... H01H 3/30 200/400

(Continued)

FOREIGN PATENT DOCUMENTS

EP 0299291 A1 1/1989
EP 0564173 A1 10/1993

OTHER PUBLICATIONS

French Search Report From FR Application No. FR 1551909, dated Dec. 10, 2015.

(Continued)

*Primary Examiner* — Edwin A. Leon
(74) *Attorney, Agent, or Firm* — Workman Nydegger

(57) ABSTRACT

An accumulator control system for one or more electrical breaker poles includes an accumulator mechanism presenting a control handle movable at least between breaking and closing positions; a first link connected to the outer carriage and pivoting about a first pivot point between first and second positions, by actuating the control handle of the accumulator mechanism between the breaking and closing positions; a second link pivotable about a pivot axis and connected to the first link by a sliding connection so that the movement of the first link, between the second and first positions, causes the second link to pivot about the pivot axis between a position for closing one or more breaker poles, and a position for opening one or more breaker poles. The control system is further configured to exert an additional (Continued)

pivoting force on the second link when the control handle is actuated beyond the breaking position.

7 Claims, 15 Drawing Sheets

(58) Field of Classification Search
CPC ..... H01H 71/1009; H01H 9/28; H01H 9/282; H01H 2071/565; H01H 71/56; H01H 2009/288
USPC ..... 200/400, 335, 43.14; 335/17
See application file for complete search history.

(56) References Cited

U.S. PATENT DOCUMENTS

| | | | | |
|---|---|---|---|---|
| 5,302,925 | A | 4/1994 | Castonguay et al. | |
| 6,800,822 | B2 * | 10/2004 | Hamada | H01H 71/58 200/308 |
| 7,459,650 | B2 * | 12/2008 | Weister | H01H 71/505 200/400 |
| 2017/0271106 | A1 * | 9/2017 | Dumont | H01H 21/30 |

OTHER PUBLICATIONS

International Search Report From PCT Application No. PCT/FR2016/050479, dated Jun. 9, 2016.

* cited by examiner

CONTROL SYSTEM FOR A BREAKER POLE WITH FORCING, AND BREAKER GEAR

BACKGROUND OF THE INVENTION

The present invention relates to the general field of electrical breaker gear, and more particularly to systems enabling breaking to be actuated in this type of gear.

This type of installation comprises one or more electrical breaker poles such as trippable switch-disconnectors, trippable fused switch-disconnectors, trippable switches, and circuit breakers. The main functions of such poles are the following:

- setting up and interrupting electric currents on load, on overload, and on short circuits;
- protecting a site and personnel against electrical risks; and
- guaranteeing user safety (actuation, lockout, and isolation).

Electrical breaker gear is fitted with a control system connected to the electrical breaker poles and from which circuit breaking is controlled. The control system constitutes the most important safety element of the installation, since it is the control system that determines the level of performance and the reliability of the electrical breaker gear and also provides the interface between a user and the electrical power portion of the electrically powered device(s).

The control system enables the user to changeover the breaker pole(s) to go from a closed position (power on) referred to as a "closing position" to an open position (power off) referred to as a "breaking position" and vice versa, by means of a control handle. More precisely, the control system comprises an accumulator mechanism formed mainly of an inner carriage connected to the control handle and of an outer carriage connected to a breaker pole control shaft, the inner carriage sliding in the outer carriage. A spring is interposed between the two carriages so as to accumulate mechanical energy during movement of the inner carriage by the control handle and to return the energy to the outer carriage at the end of the stroke of the control handle so as to enable quick and reliable opening or closing of the breaker pole(s).

However, in the event of one or more breaker poles becoming welded in the closing position, the outer carriage of the control system, which is connected to the poles by a control shaft, may remain blocked while the control handle has finished its stroke between the closing position and the breaking position. In this event, the control system is no longer usable since welding of one or more poles makes it impossible to control opening of all of the poles.

When welding of one or more breaker poles cannot be overcome by the force of the trip mechanism spring, that leads to very significant safety problems. If the control handle has been moved to reach its position corresponding to the normal position for opening the breaker poles, the operator may think that the pole(s) has/have indeed been opened when that is not so.

Furthermore, safety standards require that the handle can be locked in the breaking position. However, in the event of one or more breaker poles becoming welded, this safety requirement is ineffective if the control handle can be locked in its breaking position while the breaker pole(s) are still in their closed position.

OBJECT AND SUMMARY OF THE INVENTION

An object of the present invention is to propose a novel design for a control system that makes it possible to force breaker poles having contacts that are welded together.

This object is achieved by an accumulation control system for one or more electrical breaker poles, the system comprising:

- an accumulator mechanism comprising a control handle that is movable at least between a closing position and a breaking position, and vice versa, an inner carriage connected to the control handle and an outer carriage, the inner carriage sliding in the outer carriage during the movement of the control handle between the closing position and the breaking position, and vice versa, a spring being interposed between the inner carriage and the outer carriage;
- a first link connected to the outer carriage and pivotable about a first pivot point between a first position and a second position, and vice versa, by actuating the control handle of the accumulator mechanism between the breaking position and the closing position, and vice versa;
- a second link pivotable about a pivot axis for connecting to one or more breaker poles, the second link being connected to the first link by a sliding connection so that the movement of the first link between the first position and the second position, or conversely between the second position and the first position, causes the second link to pivot about the pivot axis between a position for opening the breaker pole(s) and a position for closing the breaker pole(s), or conversely between a position for closing the breaker pole(s) and a position for opening the breaker pole(s);
- the control system being characterized in that it includes means for exerting additional pivoting force on the second link when the control handle is actuated beyond the breaking position.

By permitting over-travel of the control handle beyond the breaking position, the control system of the present invention makes it possible to detect potential blocking (i.e. welding) of one or more breaker poles connected to the control system. If one or more breaker poles are welded, it is possible to detect it by the resistance in the control handle when it is actuated beyond the breaking position. Furthermore, when a force that is greater than the blocking force of the breaker pole(s) is applied to the control handle, the contacts of the pole(s) may be unblocked, which enables the control system to return to its normal breaking position.

In a characteristic of the control system the inner carriage includes at least one abutment suitable for coming into contact with the outer carriage when the inner carriage is moved by the control handle towards the open position of the breaker pole(s), while the outer carriage is blocked in the position for closing the breaker poles so as to force the outer carriage to move towards the breaking position by means of the control handle. By enabling the inner carriage to be put into abutment on the outer carriage, it is possible to force opening of (a) blocked breaker pole(s) using the control handle.

According to another characteristic of the control system of the invention, it includes a locking device comprising a locking element that is movable between a neutral position and a locking position making it possible to lock the accumulation control system in the breaking position, and in that said locking device further comprises control means for blocking the locking element in the neutral position when the outer carriage is blocked in the position for closing the breaker poles while the control handle is being moved into the breaking position.

Thus, the system of the invention may be locked in its breaking position in totally safe manner since it cannot be locked if the outer carriage is blocked in the position for closing the breaker poles, even if the control handle is moved into the breaking position. In other words, the control system cannot be locked if one or more breaker poles are welded in the closing position.

In an aspect of the control system of the invention, it comprises at least one rocker pawl that is movable between a high position when the outer carriage is in the position for closing the breaker poles and a low position when said outer carriage is in the position for opening the breaker poles and in that the locking device comprises a latch element that is movable between a neutral position when the rocker pawl is in the low position and a blocking position when the rocker pawl is in the high position in such a manner as to block the locking element in the neutral position when the outer carriage is blocked in the position for closing the breaker poles while the control handle is being moved into the breaking position.

The latch element is thus suitable for testing the position of the rocker pawl and for only allowing locking of the system in the breaking position if the pawl is in its low position, the position indicating that the outer carriage is in the breaking position and that, consequently, no breaker pole remains blocked in the closed position.

In an additional characteristic of the control system of the invention, the latch element is suitable for blocking movement of the control handle when said latch element is in the blocking position. Thus, any movement of the control handle is further prevented.

According to another additional characteristic of the control system of the invention, the locking element comprises a tab including an opening that is accessible when said locking element is in the locking position. It is thus possible to lock the system in the breaking position by placing one or more locks in the opening, which makes it possible to make it safe for one or more operators to act on the system.

The present invention also provides electrical breaker gear comprising one or more electrical breaker poles fitted with a movable bar, characterized in that said gear further comprises an accumulator control system of the invention, a breaker shaft connecting each movable bar of the breaker pole(s) to the pivot axis of the second link.

BRIEF DESCRIPTION OF THE DRAWINGS

Other characteristics and advantages of the invention appear from the following description of particular embodiments of the invention, given as non-limiting examples, and with reference to the accompanying drawings, in which.

DETAILED DESCRIPTION OF AN EMBODIMENT

Figure 1A:
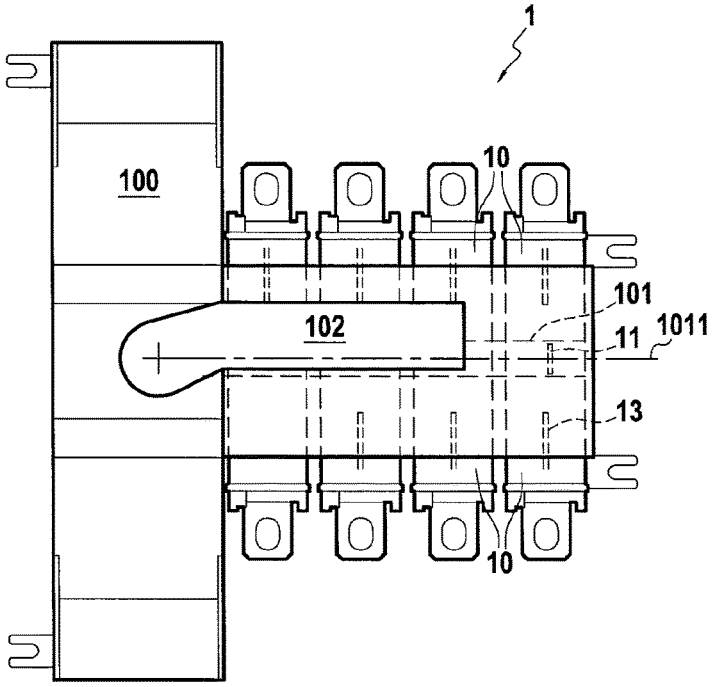
FIG. 1A is a diagrammatic view showing a trippable control system in a breaking position in an embodiment of the invention.
Figure 1B:
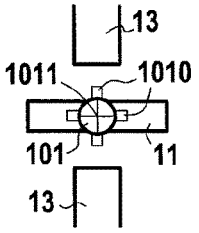
FIG. 1B shows a movable bar in the breaking position of the FIG. 1A system.

FIG. 1A shows breaker gear 1 in accordance with an embodiment of the invention. In the presently-described embodiment, the gear 1 comprises an accumulator control system 100 in accordance with an embodiment, together with a plurality of breaker poles 10. The breaker poles 10 correspond to breaker devices such as interrupters, switches, or fused switch-disconnectors. As shown in FIGS. 1A and 1B, each breaker pole 10 is connected to the accumulator control system 100 by a breaker shaft 101 that is secured firstly to a link of the system 100, as described in detail below, and secondly to each movable bar of the breaker poles that correspond in this example to a set of movable contacts 11, the shaft 101 defining the axis of rotation for the movable contacts 11. When the shaft 101 is caused to turn by the system 100, that serves to move the movable contacts 11 of each breaker pole between an opening position (FIG. 1A) in which the movable contacts 11 are placed at a distance from stationary contacts 13 of the breaker gear (FIG. 1B) and a closing position (FIG. 2A) in which the movable contacts 11 are in contact with the stationary contacts 13 of the breaker poles (FIG. 2B), and vice versa. In the presently-described embodiment, the breaker poles 10 are opened and closed, and vice versa, under the control of a control handle 102 that is movable between a first position shown in FIG. 1A referred to as the "breaking position" corresponding to the position for opening the breaker poles 10, and a second position shown in FIG. 2A referred to as the "closing position" corresponding to the position for closing the breaker poles 10.

Figure 3:
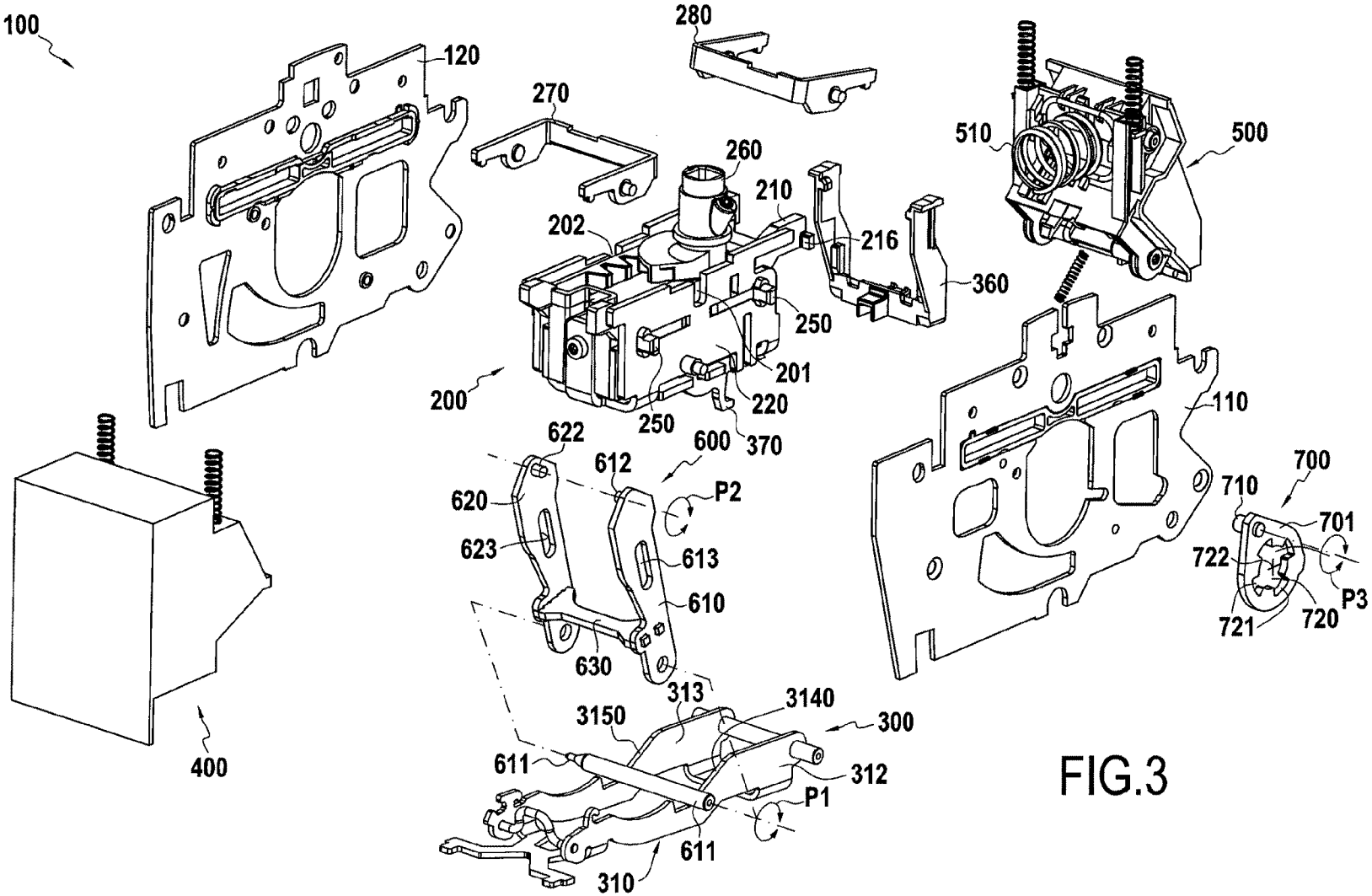
FIG. 3 is a diagrammatic exploded perspective view of the trippable control system of FIGS. 1A and 2A.

FIG. 3 shows the various elements of the accumulator control system 100 in an embodiment of the invention. The system 100 comprises:

an accumulator mechanism 200;
a trip mechanism 300;
a trip control module 400;
an auxiliary contact module 500;
a first pivotal link 600; and
a second pivotal link 700.

These elements are assembled together and held by two sheet-metal cheek-plates 110 and 120.

Figure 4:
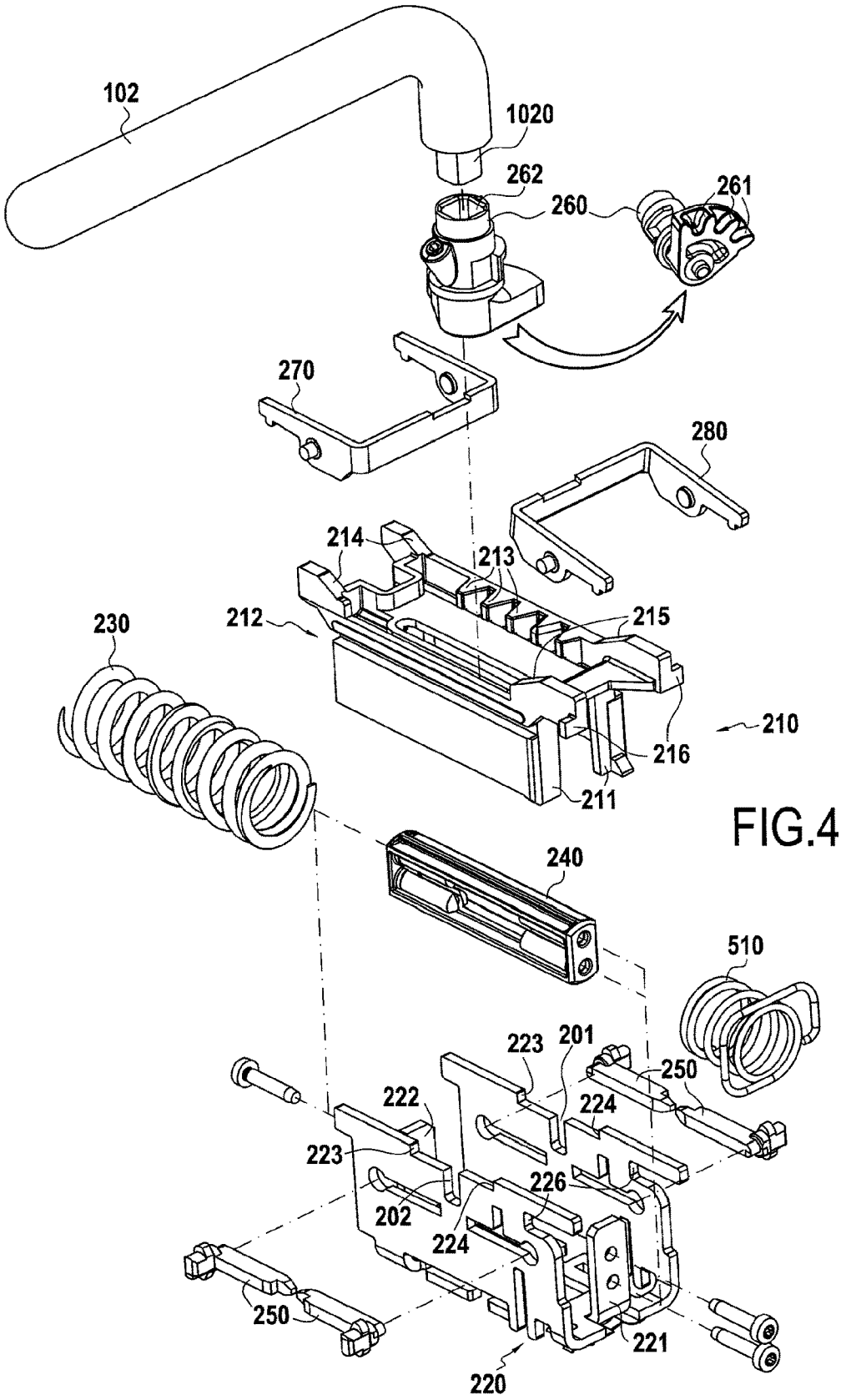
FIG. 4 is a diagrammatic exploded perspective view of the accumulator mechanism shown in FIG. 3.

As shown in FIG. 4, the accumulator mechanism 200 comprises:

an inner carriage 210;
an outer carriage 220;
an accumulator spring 230;
a spring guide 240;
carriage guides 250;
an angle transmission 260;
a first rocker pawl 270; and
a second rocker pawl 280.

Figure 5:
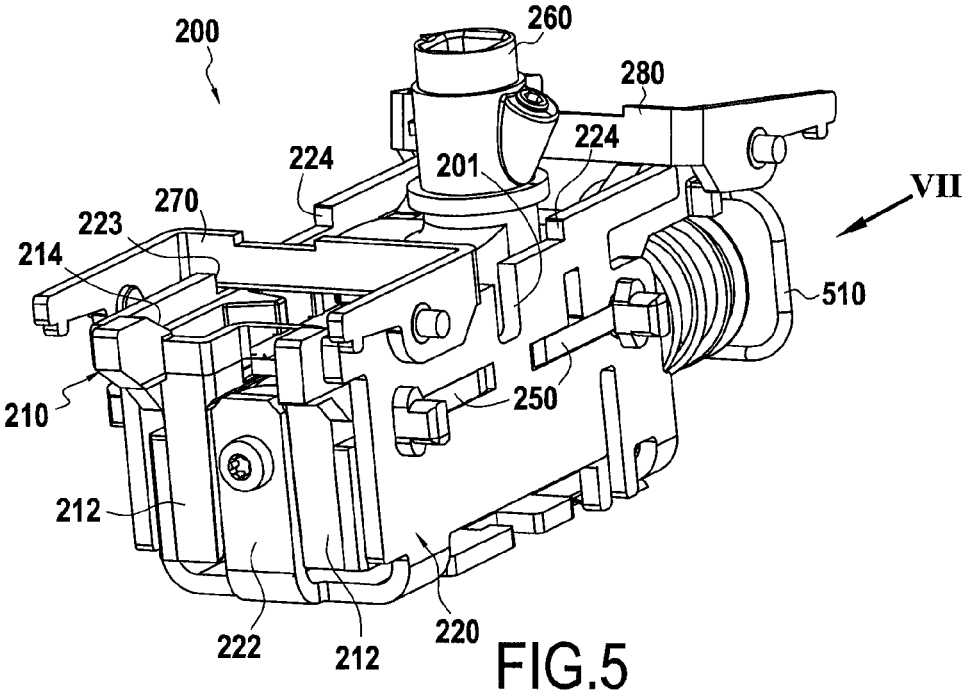
FIGS. 5 and 6 are perspective views of the accumulator mechanism once assembled.
Figure 6:
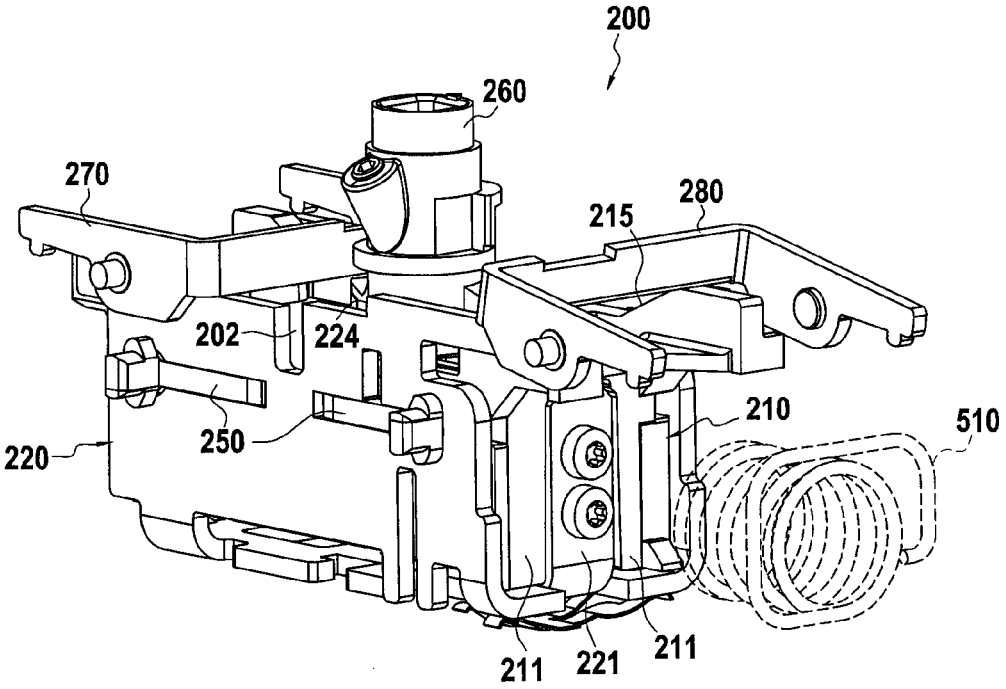
Figure 9:
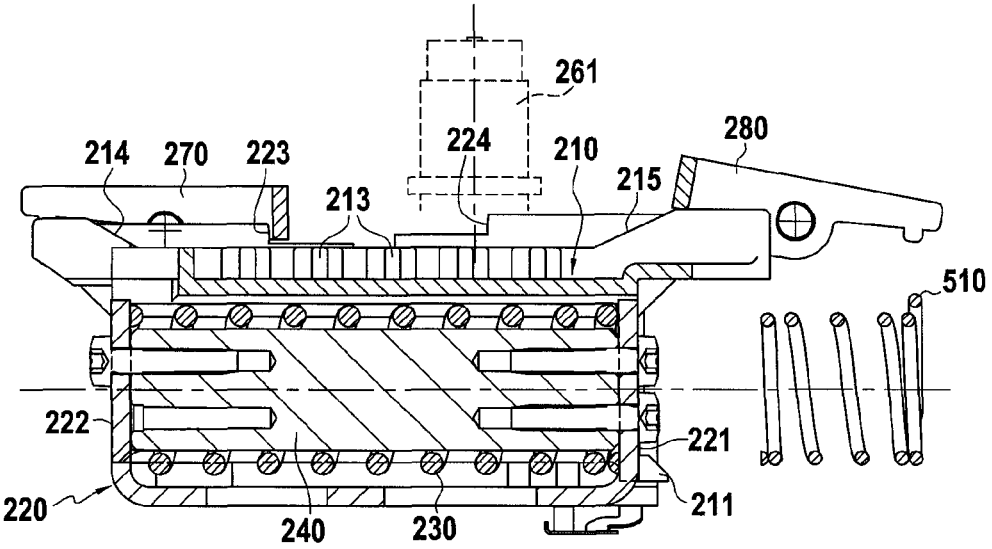
FIG. 9 is a section view of the accumulator mechanism when the trippable control system is in a breaking position.

The inner and outer carriages 210 and 220 are mounted to slide relative to each other, the carriage guides 250 directing relative sliding between the two carriages. While assembling the inner carriage 210 in the outer carriage 220, the accumulator spring 230 is interposed between the two carriages. More precisely, the spring 230 is held on the spring guide 240 that is itself fastened to two fastener tabs 221 and 222 respectively present at the two ends of the outer carriage 220. At rest, the spring 230 extends between the two tabs 221 and 222, as shown in FIG. 9. The inner carriage 210 has two pairs of thrust tabs 211 and 212 each arranged respectively on either side of the tabs 221 and 222 (FIGS. 4, 5, and 6). As explained below, the thrust tabs 211 and 212 are for coming into abutment against one of the ends of the spring 230 in order to compress it during movement of the inner carriage inside the outer carriage during operations of opening and/or closing the breaker gear 10. The inner carriage 210 has rack teeth 213 on its top portion for co-operating with gears 261 of the control shaft 260. The control shaft 260 also has a housing 262 suitable for receiving the shaft 1020 of the handle 102.

Figure 2A:
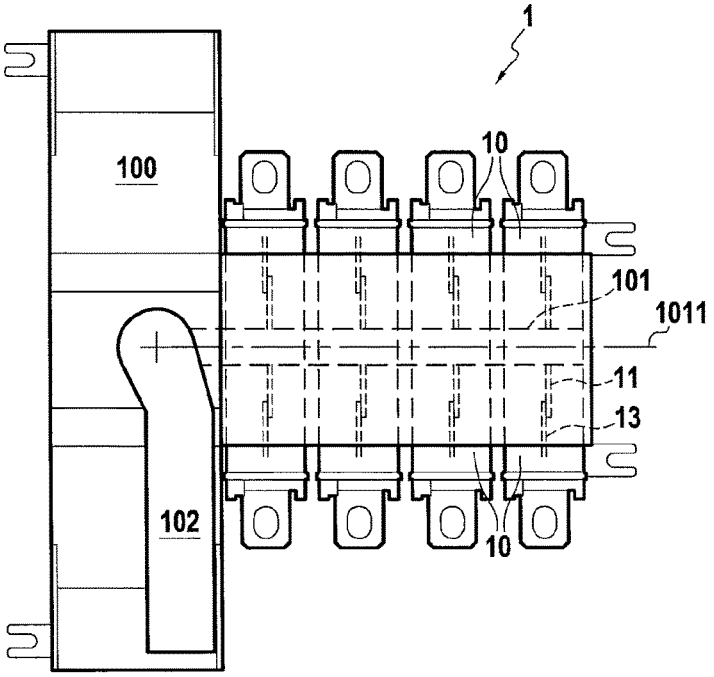
FIG. 2A is a diagrammatic view showing a trippable control system in a closing position in accordance with an embodiment of the invention.
Figure 2B:
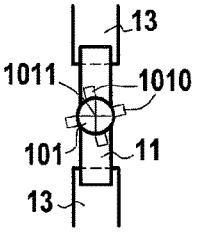
FIG. 2B shows a movable bar in the closing position of the FIG. 2A system.

As shown in FIG. 3, the first pivotal link 600 comprises an arm 610 suitable for pivoting about a first pivot point P1 formed by a pin 611 that is held by the trip mechanism 300. The arm 610 also has at its top end a pin 612 that is crimped to said top end and that is for engagement in an opening 201 formed in the outer carriage 220. The pin 612 constitutes a second pivot point P2 about which the arm of the link 600 can pivot. In the presently-described embodiment, the link 600 has a second arm 620 connected to the first arm 610 by a crossbar 630. In symmetrical manner, the second arm is suitable for pivoting firstly about the pivot point P1 and secondly about the second pivot point P2, the arm 620 having a pin 622 crimped to its top end for engaging in an opening 202 formed in the outer carriage. The second pivotal link 700 comprises a body 701 having an opening 720 for receiving one end of the shaft 101 for causing the breaker poles 10 to open and close. In order to enable the shaft 101 to be turned, the opening 720 includes crenellations 721 for co-operating with teeth 1010 present on the outside surface of the shaft 101 (FIGS. 1B and 2B). The center 722 of the opening 720 coincides with the center 1011 of the shaft 101. The second link 700 further includes a peg 710 present on the body 701 in a position that is offset from the position of the opening 720. The peg 720 is designed to be engaged in an oblong slot 613 formed in the arm 610 of the link 600 and to slide therein during movements of the link 600 so as to provide a sliding and hinged connection between the links 600 and 700.

Figure 7:
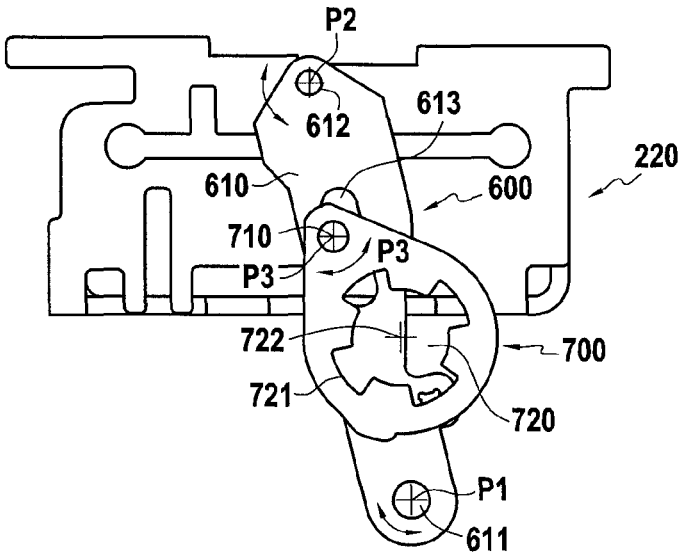
FIG. 7 is a simplified diagrammatic view showing the position of the first and second links when the control system is in a breaking position.
Figure 8:
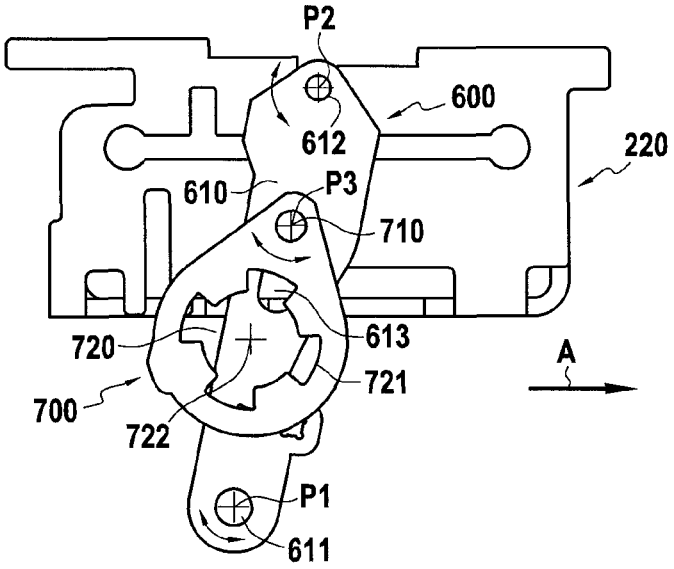
FIG. 8 is a simplified diagrammatic view showing the positions of the first and second links when the control system is actuated towards a closing position.

FIG. 7 shows the links 600 and 700 together with the outer carriage 220 in a position corresponding to the breaker gear being open, as shown in FIGS. 1A and 1B. FIG. 8 shows the outer carriage 220 moved in the direction A, thereby causing the first link 600 to pivot about the first pivot point P1 that in turn has driven pivoting of the second link 700 about the center 722 of the opening 720 by the peg 710 sliding in the oblong slot 613, the center 722 corresponding to the pivot axis of the second link 700. Pivoting of the link 700 causes the shaft 101 (not shown in FIG. 8) to turn through an angle that is sufficient to close the breaker poles, as shown in FIGS. 2A and 2B.

There follows an explanation about how tripping of the movement of the outer carriage between the position for opening the breaker poles and the position for closing the breaker poles, and vice versa, is controlled.

Figure 10:
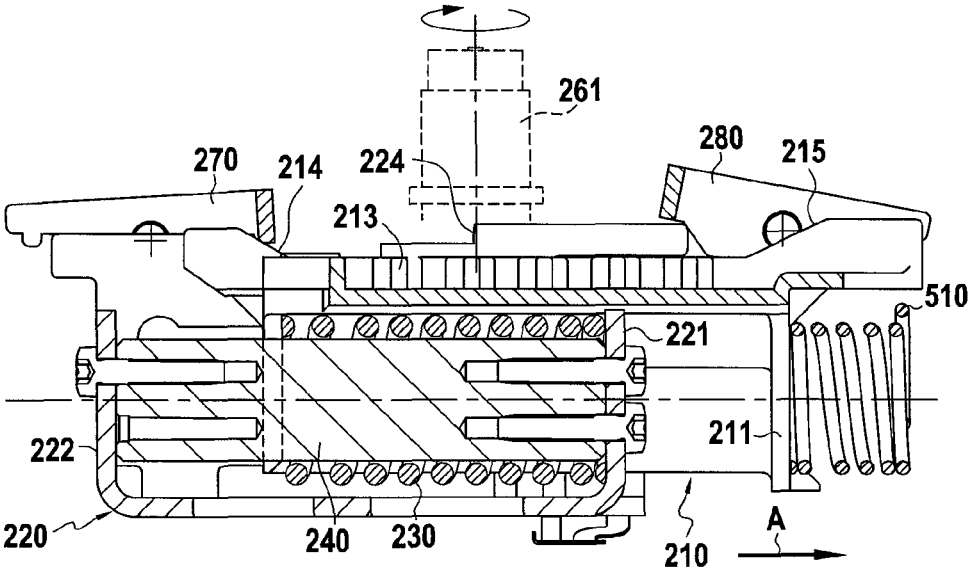
FIG. 10 is a section view of the accumulator mechanism when the control handle of the trippable control system is actuated towards a closing position, with the spring of the accumulator mechanism compressed.
Figure 11:
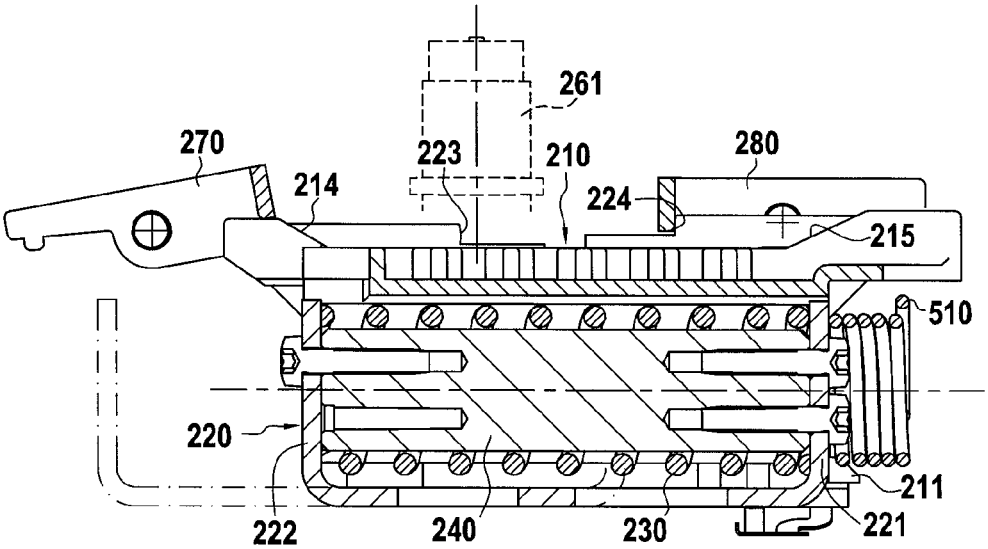
FIG. 11 is a section view of the accumulator mechanism when the trippable control system is in a closing position.

FIGS. 9, 10, and 11 show the relative movements of the inner and outer carriages 210 and 220 for passing from the position for opening the breaker poles to the position for closing the breaker poles by tripping the movement of the outer carriage. FIG. 11 shows the inner and outer carriages 210 and 220 in their breaking position corresponding to the positions of the first link 600 and of the second link 700 shown in FIG. 7 (i.e. the position for opening the breaker poles). FIG. 11 shows the inner and outer carriages 210 and 220 in their breaking position corresponding to the positions of the first link 600 and of the second link 700 shown in FIG. 8 (i.e. the position for closing the breaker poles).

The first rocker pawl 270 serves momentarily to block movement of the outer carriage 220 in the direction A shown in FIG. 10 so as to make it possible, initially, to compress the accumulator spring 230 (FIG. 10), and subsequently to trip the movement of the outer carriage 220 in the direction A under the effect of the action of the spring 230 (FIG. 11). More precisely, as shown in FIG. 9, when the first pawl 270 is in its low position, it bears against rims 223 provided in the top portion of the outer carriage 220, thereby enabling the outer carriage to be held. In its top portion, the inner carriage 210 has two ramps 214 that are designed to lift the first rocker pawl 270 during the movement of the inner carriage 210 in the direction A as shown in FIG. 10 and to disengage the pawl 270 progressively from the rims 223, until movement of the outer carriage is released, as shown in FIG. 12.

Figure 12:
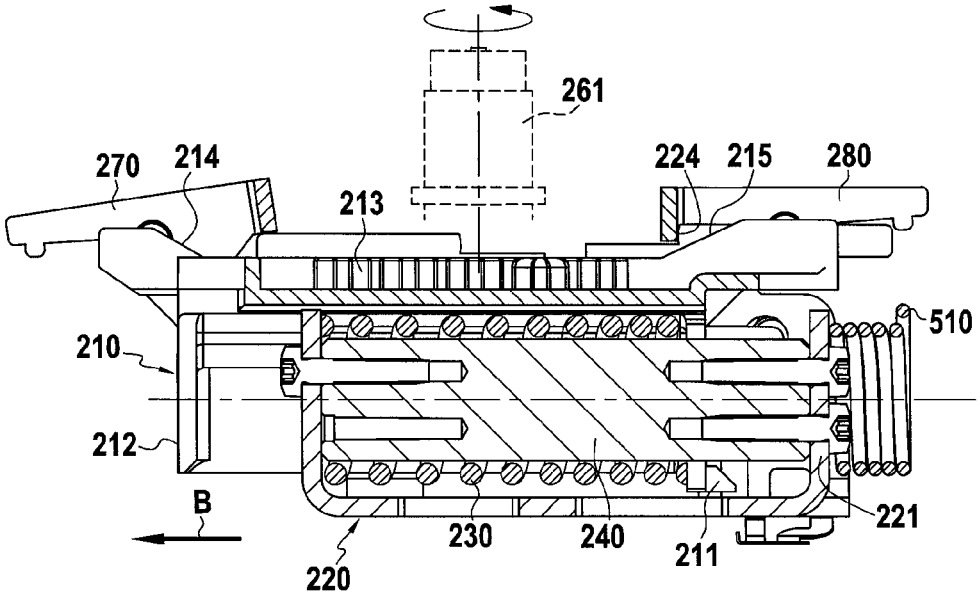
FIG. 12 is a section view of the accumulator mechanism when the control handle of the trippable control system is actuated towards an opening position with the spring of the accumulator mechanism compressed.

In the same manner, FIGS. 11, 12, and 9 show the relative movements of the inner and outer carriages that serve to pass from the position for closing the breaker poles to the position for opening the breaker poles by tripping the movement of the outer carriage, FIG. 9 showing the relative position between the carriages 210 and 220 corresponding to the positions of the links 600 and 700 shown in FIG. 7 (position for opening the breaker poles), with FIG. 11 showing the relative position between the carriages 210 and 220 corresponding to the positions of the links 600 and 700 shown in FIG. 8 (position for closing the breaker poles).

The second rocker pawl 280 is designed momentarily to block movement of the outer carriage 220 in the direction B shown in FIG. 12 so as to make it possible initially to compress the accumulator spring 230 (FIG. 12), and subsequently to trip the movement of the outer carriage 220 in the direction B under the effect of the action of the spring 230 (FIG. 9). More precisely, as shown in FIG. 11, when the second pawl 280 is in its low position, it bears against rims 224 provided in the top portion of the outer carriage 220, thereby serving to retain the outer carriage. In its top portion, the inner carriage 210 has two ramps 215 that are designed to lift the first rocker pawl 280 during movement of the inner carriage 210 in the direction B, as shown in FIG. 12 and to disengage the pawl 280 progressively from the rims 224, until the movement of the outer carriage is released, which carriage then moved into the breaking position as shown in FIG. 9.

There follows a description of the operation consisting in forcing opening of one or more breaker poles when one or more of them is/are blocked in the closing position, i.e. when at least one movable contact 11 of a breaker pole 10 connected to the accumulator control system 100 remains welded to the stationary contact 13 of the pole.

Figure 13A:
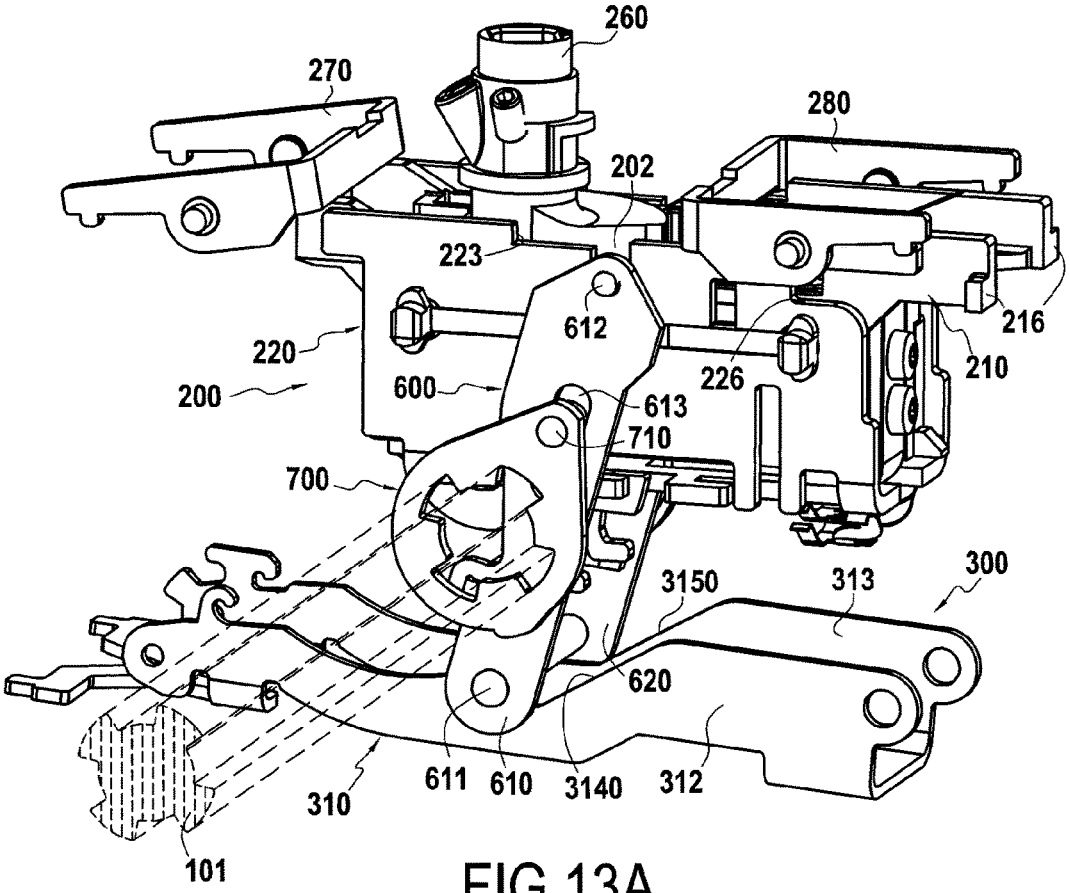
FIG. 13A is a diagrammatic perspective view showing some of the component elements of the accumulator control system of FIGS. 1A and 2A when it is in a closing position.
Figure 13B:
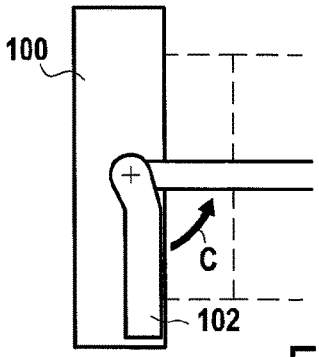
FIG. 13B is a diagrammatic view showing the position of the control handle of the accumulator control system of FIG. 13A.

At the start, the accumulator control system 100 is in the closing position as shown in FIG. 13A and corresponding to the position of the breaker poles 10 as shown in FIGS. 2A and 2B. The control handle 102 that is in its closing position is thus actuated towards its breaking position as indicated by arrow C in FIG. 13B.

Figure 14A:
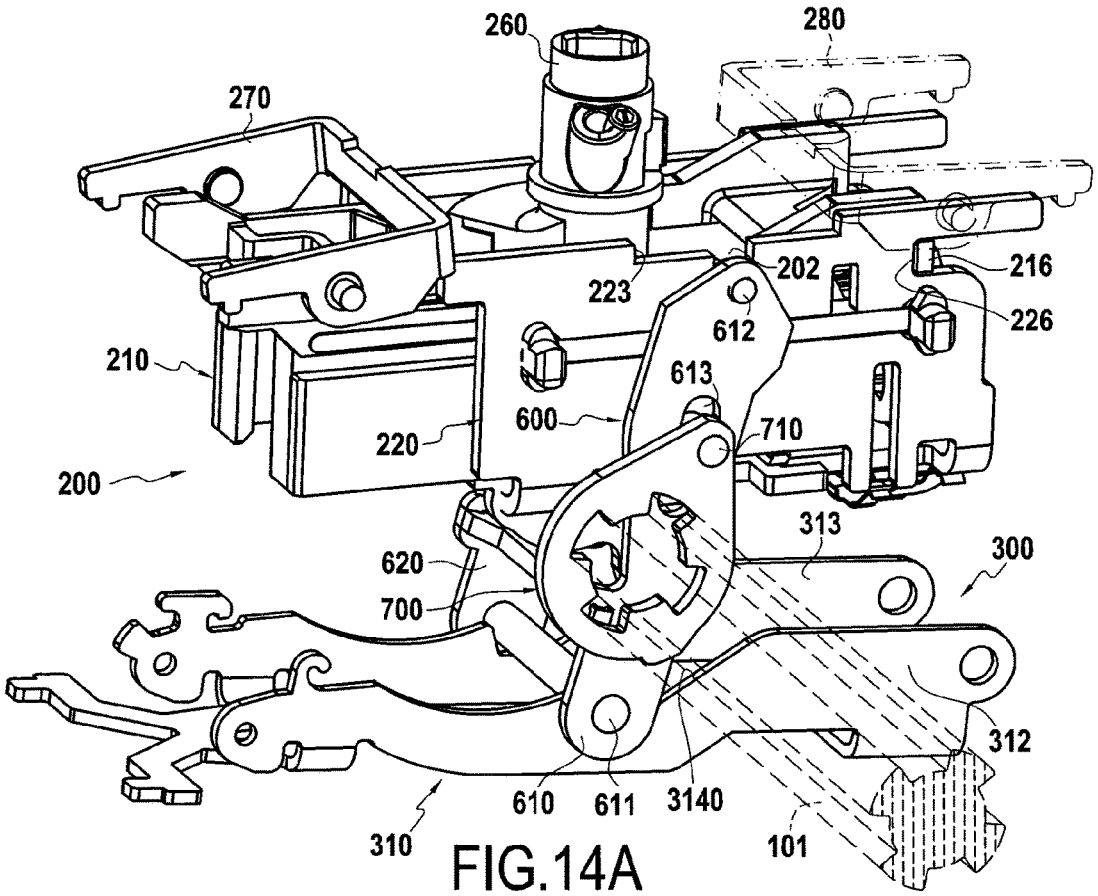
FIG. 14A is a diagrammatic perspective view of the system of FIG. 13A when the outer carriage is blocked in the position for closing the breaker poles while the control handle is turned towards the breaking position.
Figure 14B:
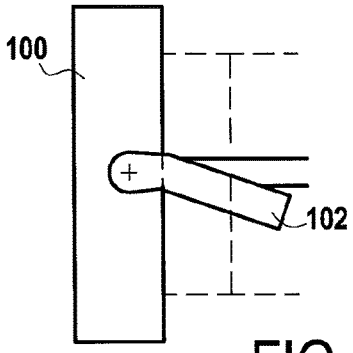
FIG. 14B is a diagrammatic view showing the position of the control handle of the accumulator control system of FIG. 14A.

FIG. 14A shows the position of the trippable control system 100 when the control handle 102 has been tilted to its breaking position, as shown in FIG. 14B, while one or more of the breaker poles 10 remain blocked in their closing position. In this event, as shown in FIG. 14A, the inner carriage 210 slides until it reaches a position usually enabling the outer carriage to be tripped to move into its breaking position under the effect of the spring 230 (not visible in FIG. 14A) and by the rocker pawl 280 releasing the outer carriage 220 as explained above. However, in the embodiment described, at least one of the breaker poles connected to the system 100 is blocked in its closing position, which has the effect of blocking rotation of the breaker shaft 101 and of preventing any changeover of the links 700 and 600. Since the first link 600 is blocked in its closing position, the outer carriage 220 cannot slide in its opening position and remains blocked in its closing position as shown in FIG. 14A.

As shown in FIG. 4, the inner carriage 210 includes abutments 216 that are designed to come to bear against contact portions 226 made on the outer carriage when said outer carriage is blocked in its closing position as shown in FIG. 14A. As explained below, the abutments 216 make it possible to apply force on the outer carriage by using the inner carriage.

Figure 15A:
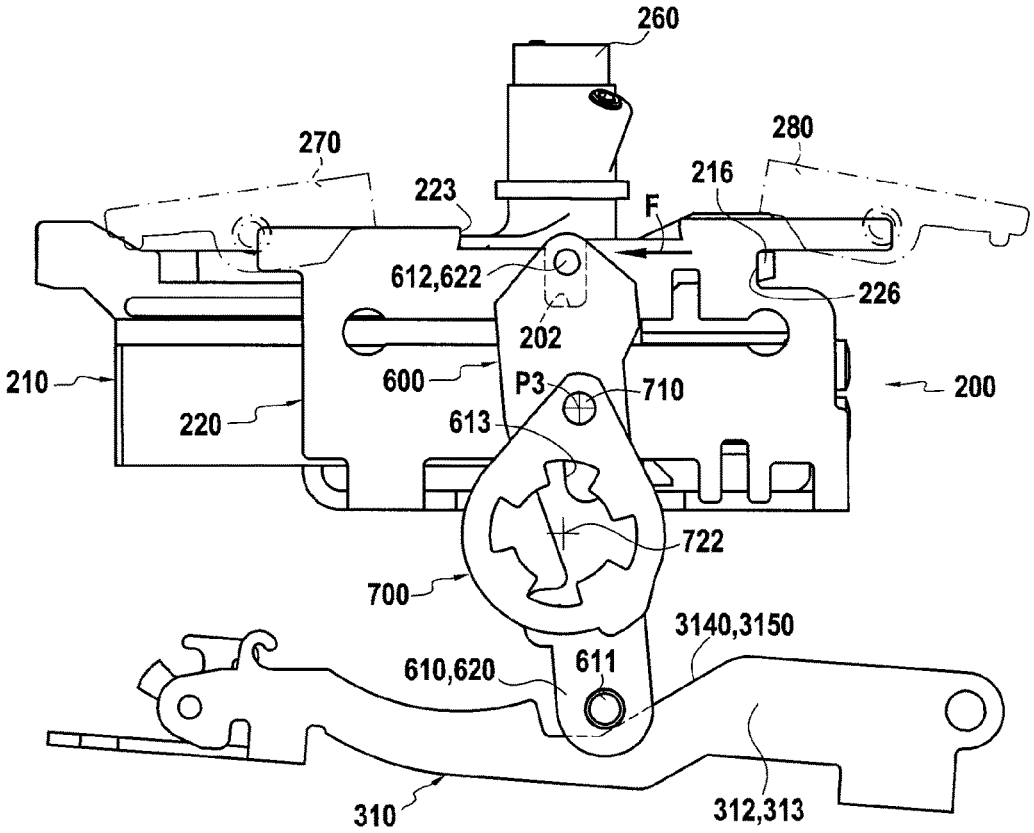
FIG. 15A is a diagrammatic perspective view showing the system of FIG. 14A when the inner carriage begins to force the outer carriage.
Figure 15B:
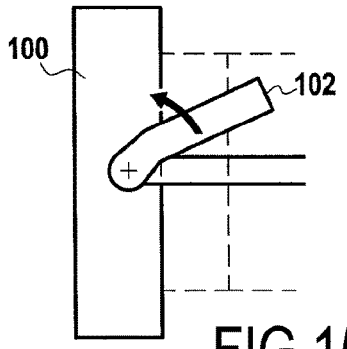
FIG. 15B is a diagrammatic view showing the position of the control handle of the accumulator control system of FIG. 15A.
Figure 16A:
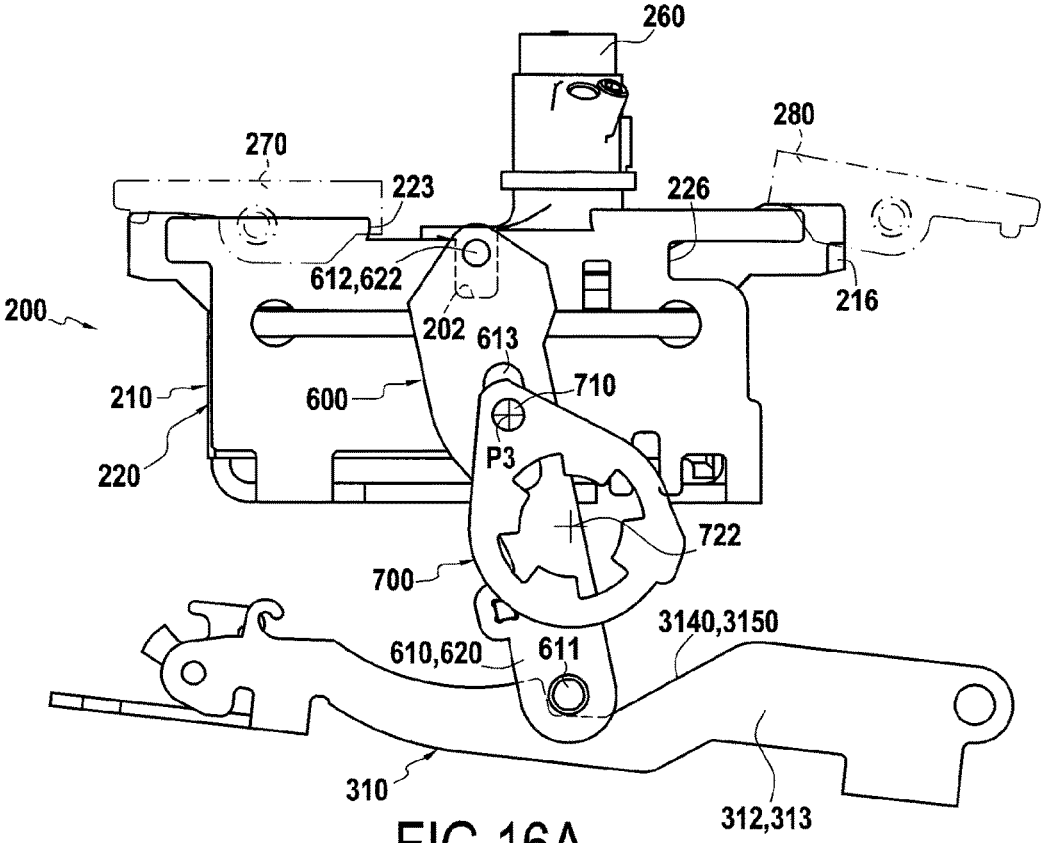
FIG. 16A is a diagrammatic perspective view showing the system of FIG. 15A after forcing and unblocking the breaker poles.
Figure 16B:
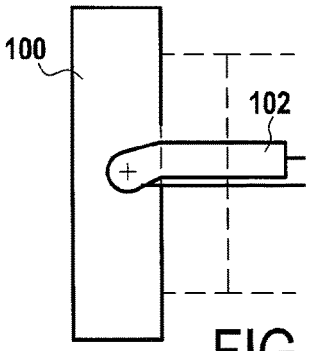
FIG. 16B is a diagrammatic view showing the position of the control handle of the accumulator control system of FIG. 16A.

Forcing opening of the breaker pole(s) of the invention begins from the position of the control system as shown in FIG. 14A. As shown in FIG. 15B, the control handle 102 is then actuated beyond its breaking position in such a manner as to move the inner carriage 210 beyond its breaking position. Since the inner carriage 210 is in abutment against the outer carriage 220, it exerts force on the outer carriage so as to move it towards its breaking position. The forcing of the outer carriage 220 against the inner carriage, via pins 612 and 622 engaged with the outer carriage, drives pivoting of the first link 600 about a third pivot point P3 corresponding to the peg 710 of the second link 700, which is engaged in the oblong slot 613 formed in the arm 610 of the first link 600. The link 600 will rock around the pivot point P3 until it comes into abutment. Since the link 600 is in abutment against the sloping portions 3140 and 3150, the force F exerted by the outer carriage 220 on the pins 612 and 622 directly opposes the blocking force transmitted to the link 700 via the breaker shaft 101 so as to continue rocking of the link 600 about the pivot point P3. When a force that is greater than the blocking force of the welded together breaker pole(s) is applied to the control handle 102, the contacts of the poles are unwelded, and that makes it possible to release any stress on the link 700. The movement of the outer carriage is thus no longer blocked, so said outer carriage thus moves into the breaking position under the effect of the spring 230 (not visible in FIG. 15A), which position is shown in FIG. 16A. Once released, the control handle 102 returns to its normal breaking position as shown in FIG. 16B.

In the presently-described embodiment, the pin 611 of the first link 600 comes into abutment against sloping portions 3140 and 3150 present on the hook 310 of the trip mechanism 300. However, the accumulator control system of the invention need not comprise such a trip mechanism. In this event, the system of the invention merely comprises an abutment fastened in a position corresponding to the position in which the pin 611 connecting together the arms 610 and 620 of the first link 600 comes into abutment against sloping portions 3140 and 3150 present respectively on the first and second arms 312 and 313 of the hook 310.

In accordance with an embodiment of the accumulator control system of the invention, said system further comprises a locking device making it possible to lock the control system in the position for opening the poles. The locking device makes it possible to control breaking of all of the energy sources controlled by the breaker pole(s) connected to the control system. During any intervention on a piece of equipment, a system, or a machine, it is therefore possible to isolate all of the dangerous energy sources in safe manner and to do so until the end of that intervention.

Figure 17A:
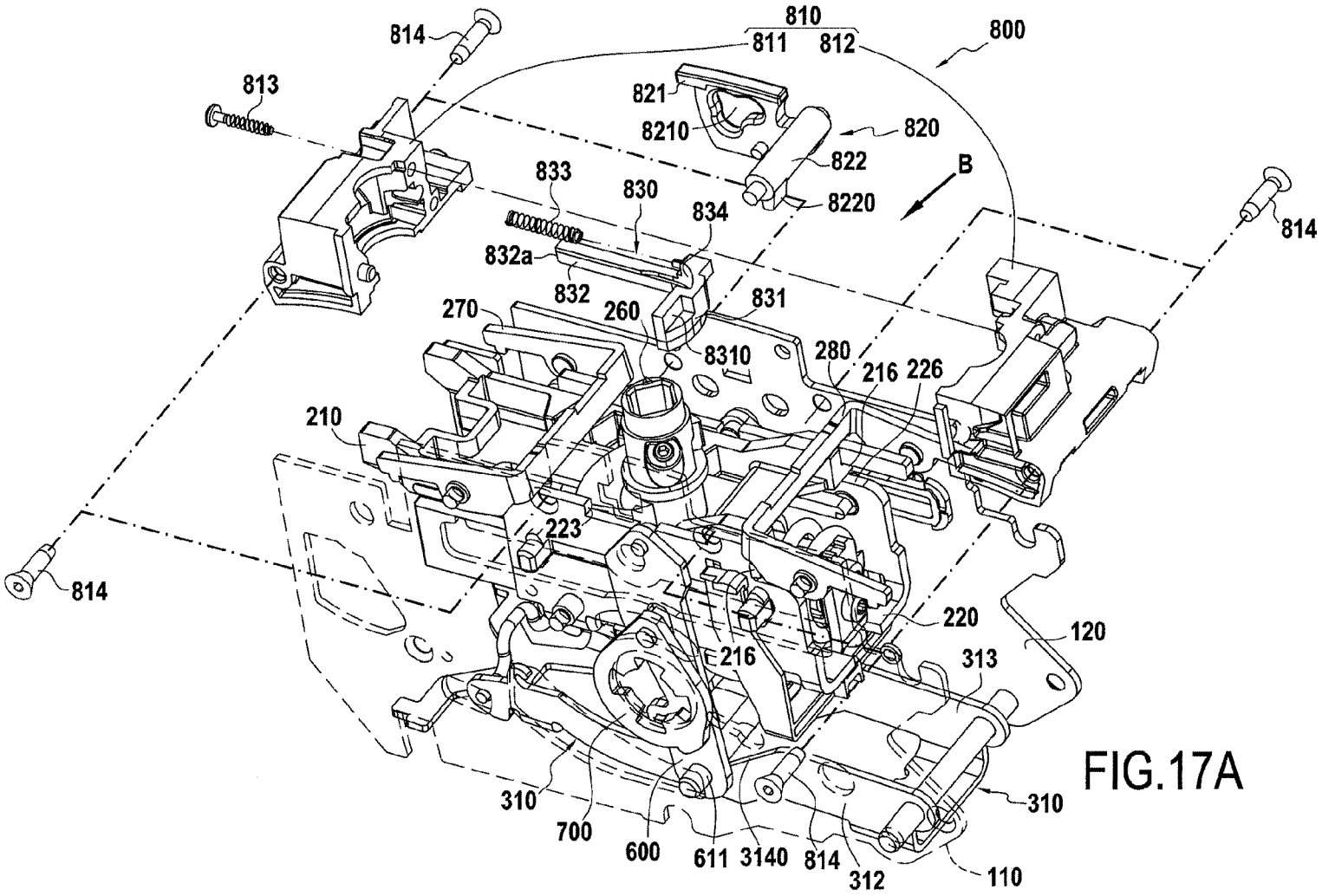
FIG. 17A is a diagrammatic exploded view in perspective showing part of the accumulator control system of the invention provided with a locking device.
Figure 17B:
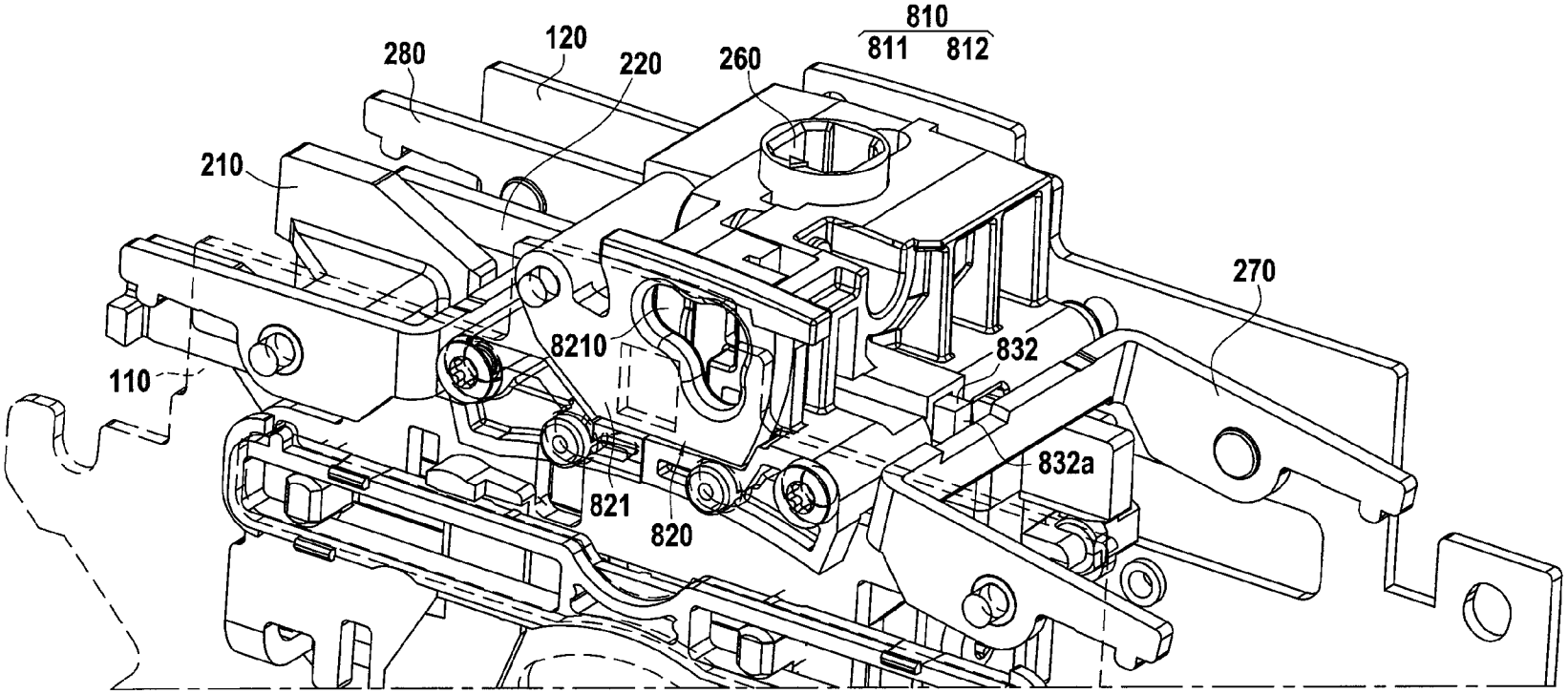
FIG. 17B is a diagrammatic perspective view of the system of FIG. 17A once the locking device is mounted, the control system being in the closing position.
Figure 18:
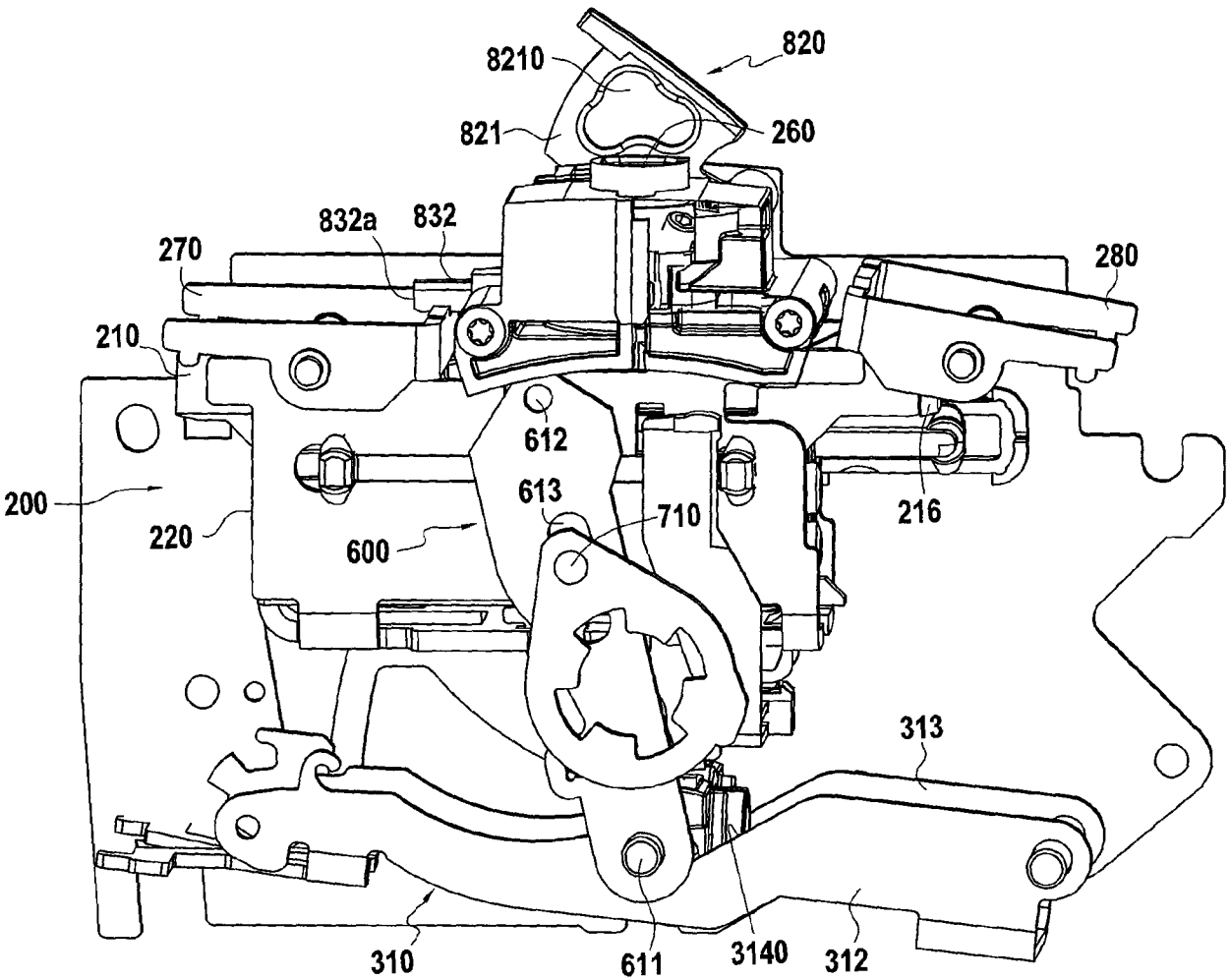
FIG. 18 is a diagrammatic perspective view of the accumulator control system of FIGS. 17A and 17B in the breaking position.

A locking device 800 according to an embodiment of the invention and used with the above-described accumulator control device 100 is shown in FIGS. 17A and 17B. The device 800 comprises a casing 810 formed in two parts 811 and 812 that are fastened together by a screw 813, the casing being fastened to the cheek-plates 110 and 120 of the accumulator control system 100 by screws 814. The casing 810 encloses a latch element 820 and a latch element 830 designed to co-operate together as described below. The latch element 820 comprises a locking tab 821 connected to a pin 822 held in the casing 810 and by means of which the locking tab is able to pivot between a retracted position in the casing 810 as shown in FIG. 17B and corresponding to the neutral position of the latch element 820, and an extended position of the casing 810 as shown in FIG. 18 and corresponding to the locking position of the latch element 820. In the locking position of the latch element, since the tab 821 is outside the casing, it is possible to place one or more locks in an opening 8210 made in the tab 821 so as to lock the system 100 in the breaking position.

However, in order avoid any locking of the system 100 when one or more breaker poles that are connected thereto are welded in the closed position, the locking device 800 uses a latch element 830 that makes it possible to prevent the locking tab 821 extending, and does so even if the control handle is moved into its breaking position. As shown in FIGS. 19A, 19B, 20A, and 20B, the latch element 830 comprises a blocking portion 831 for co-operating with the latch element 820 and the angle transmission 260. A rod 832 for testing the position of the rocker pawl 280 extends from the blocking portion 831.

More precisely, the pin 822 of the latch element 820 is provided with a lug 8220 that is in contact with a bearing portion 8310 of the blocking portion 831 of the latch element 830. The pivoting of the locking tab 821 between its retracted position (FIGS. 19A and 19B) and its extended position outside the casing (FIGS. 20A and 20B) causes the latch element to move between its neutral position and its blocking position corresponding to a movement in translation of the latch element 830 towards the rocker pawl 270.

Figure 19A:
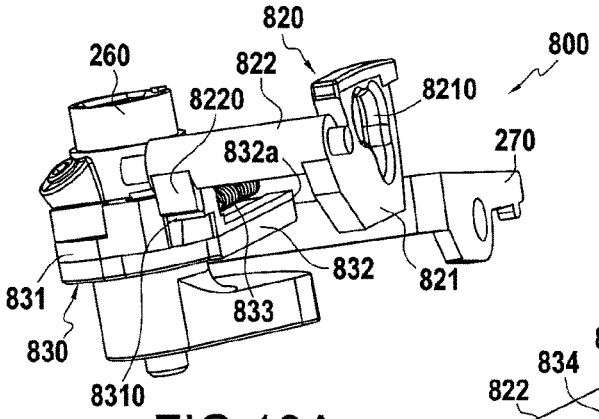
FIGS. 19A and 19B are diagrammatic perspective views showing the component elements of the locking device when the outer carriage is blocked in the position for closing the breaker poles.
Figure 19B:
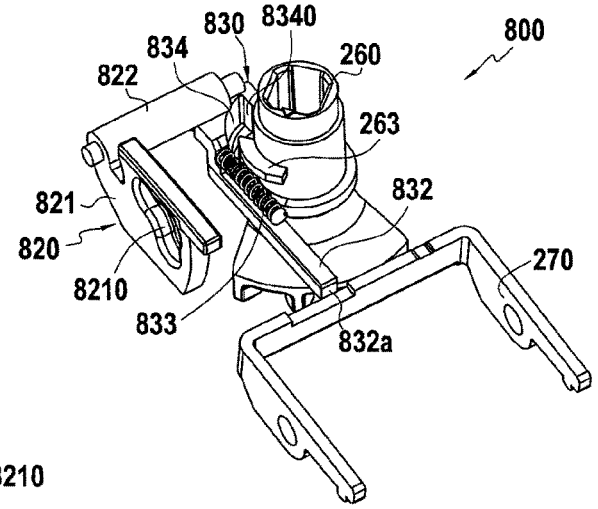

When the rocker pawl 270 is in its high position while the control handle has been turned until it reaches its breaking position as shown in FIGS. 14A and 14B respectively, that corresponds to the situation in which one or more breaker poles connected to the system 100 are blocked in the closed position. In this event, the free end 832*a* of the rod 832 is located in abutment against the pawl 270 as shown in FIGS. 19A and 19B such that the latch element 830 is unable to move. In this position, the latch element 830 prevents pivoting of the locking tab in its extended position outside the casing and no lock can be placed in the opening 8210 of the tab 821.

Figure 20A:
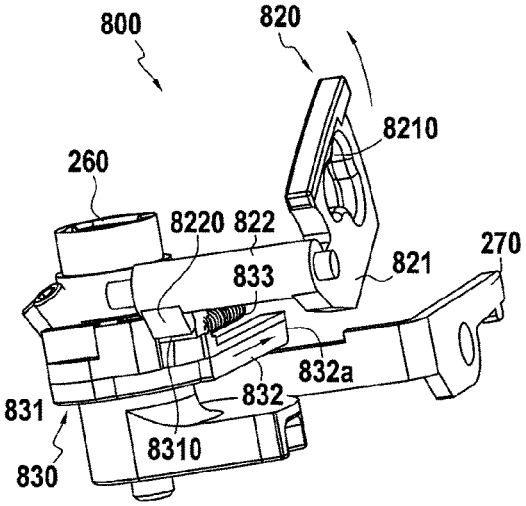
FIGS. 20A and 20B are diagrammatic perspective views showing the component elements of the locking device when the outer carriage is blocked in the position for opening the breaker poles.
Figure 20B:
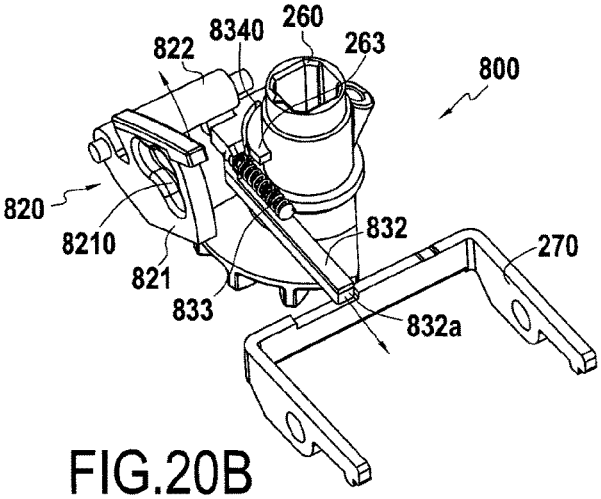

When a force greater than the blocking force of the welded-together breaker pole(s) is applied on the control handle as explained above, the contacts of the pole(s) are unblocked and the system 100 returns to its normal breaking position as shown in FIG. 16A. The rocker pawl 270 then returns to its low position, thus releasing the free end 832*a* of the rod 832. The latch element 830 may thus move freely and enable the locking tab 821 to pivot in its extended position outside the casing as shown in FIGS. 20A and 20B. A return spring 833 ensures that the latch element 830 returns to its neutral position once the locking tab 821 has returned into the casing 800.

The latch element 830 further enables rotation of the control handle 102 to be blocked once the locking tab is outside the casing. The blocking portion 831 of the latch element includes a recess 834 comprising an abutment 8340 for co-operating with a key 263 present on the angle transmission 260 (FIG. 19B) when the latch element is in its blocking position as shown in FIG. 20B. In this position, the movement of the angle transmission is blocked in rotation in the direction for closing the breaker pole(s) 10, thus preventing any movement of the control handle in this direction.

Although the force exerted by the operator on the control handle (limited to three times the normal operating force) does not enable the welded-together contacts to be opened, locking of the control system remains impossible. Furthermore, after reducing the force on the handle, said handle takes up a position indicating clearly to the operator that the gear is still in a closing position (as required by standards).

The control system of the invention also makes it possible to exceed the force defined by the standard (i.e. three times the normal operating force), consequently providing greater safety in an electrical installation.

The invention claimed is:

1. An accumulator control system for one or more electrical breaker poles, the system comprising:

an accumulator mechanism comprising a control handle that is movable at least between a closing position and a breaking position, and vice versa, an inner carriage connected to the control handle and an outer carriage, the inner carriage sliding in the outer carriage during movement of the control handle between the closing position and the breaking position, and vice versa, a spring being interposed between the inner carriage and the outer carriage;

a first link connected to the outer carriage and pivoting about a first pivot point between a first position and a second position, and vice versa, by actuating the control handle of the accumulator mechanism between the breaking position and the closing position, and vice versa;

a second link pivotable about a pivot axis for connecting to one or more breaker poles, the second link being connected to the first link by a sliding connection so that the movement of the first link between the first position and the second position, or conversely between the second position and the first position, causes the second link to pivot about the pivot axis between a position for opening the breaker pole(s) and a position for closing the breaker pole(s), or conversely between a position for closing the breaker pole(s) and a position for opening the breaker pole(s);

wherein the control system includes means for exerting additional pivoting force on the second link when the control handle is actuated beyond the breaking position.

2. A system according to claim 1, wherein the inner carriage includes at least one abutment suitable for coming into contact with the outer carriage when the inner carriage is moved by the control handle towards the breaking position of the breaker pole(s) while the outer carriage is blocked in the position for closing the breaker poles so as to force the outer carriage to move towards the position for opening by means of the control handle.

3. A system according to claim 1, wherein it includes a locking device comprising a locking element that is movable between a neutral position and a locking position making it possible to lock the accumulation control system in the breaking position, and wherein said locking device further comprises control means for blocking the locking element in the neutral position when the outer carriage is blocked in the position for closing the breaker poles while the control handle is being moved into the breaking position.

4. A system according to claim 3, wherein it comprises at least one rocker pawl that is movable between a high position when the outer carriage is in the position for closing the breaker poles and a low position when said outer carriage is in the position for opening the breaker poles and wherein the locking device comprises a latch element that is movable between a neutral position when the rocker pawl is in the low position and a blocking position when the rocker pawl is in the high position in such a manner as to block the locking element in the neutral position when the outer carriage is blocked in the position for closing the breaker poles while the control handle is being moved into the breaking position.

5. A system according to claim 4, wherein the latch element is suitable for blocking movement of the control handle when said latch element is in the blocking position.

6. A system according to claim 3, wherein the locking element comprises a tab including an opening that is accessible when said locking element is in the locking position.

7. Electrical breaker gear comprising one or more electrical breaker poles fitted with a movable bar, wherein said gear further comprises an accumulation control system according to claim 1, a breaker shaft connecting each movable bar of the breaker pole(s) to the pivot axis of the second link.

* * * * *